US008621759B2

(12) United States Patent
Reimer

(10) Patent No.: US 8,621,759 B2
(45) Date of Patent: Jan. 7, 2014

(54) METHOD AND SYSTEM FOR ATTENUATING A WAVELENGTH SHIFTING SOURCE

(75) Inventor: Christopher Jacob Reimer, Midland (CA)

(73) Assignee: Raytheon Canada Limited, Ottawa, Ontario (CA)

( * ) Notice: Subject to any disclaimer, the term of this patent is extended or adjusted under 35 U.S.C. 154(b) by 677 days.

(21) Appl. No.: 12/943,683

(22) Filed: Nov. 10, 2010

(65) Prior Publication Data

US 2012/0110887 A1 May 10, 2012

(51) Int. Cl.
*G02B 27/34* (2006.01)
*G02B 27/10* (2006.01)
*F41G 1/34* (2006.01)

(52) U.S. Cl.
USPC ..... 33/275 R; 33/227; 42/113; 42/131; 42/132

(58) Field of Classification Search
USPC ..... 33/275 R, 227, 228, 263, 265, 286; 42/111, 113, 114, 115, 117, 131, 132, 42/135, 145
See application file for complete search history.

(56) References Cited

U.S. PATENT DOCUMENTS 3,880,529 A 4/1975 Althause et al.
4,346,995 A 8/1982 Morris
5,205,044 A 4/1993 DePaoli
5,410,815 A * 5/1995 Parikh et al. ..... 42/115
5,594,584 A 1/1997 Kay et al.
5,838,239 A * 11/1998 Stern et al. ..... 340/583
6,055,053 A * 4/2000 Lesniak ..... 356/366
7,224,446 B2 * 5/2007 Kreh et al. ..... 356/237.4
7,230,684 B2 * 6/2007 Staley et al. ..... 356/4.01
7,234,265 B1 6/2007 Cheng et al.
7,355,790 B1 * 4/2008 Wagner et al. ..... 359/424
7,497,586 B2 * 3/2009 Eisenberg et al. ..... 362/109
7,516,571 B2 * 4/2009 Scrogin et al. ..... 42/114
7,784,192 B2 * 8/2010 Jancic et al. ..... 33/286
2003/0035301 A1 * 2/2003 Gardiner et al. ..... 362/583
2004/0047586 A1 3/2004 Schick et al.
2005/0252062 A1 * 11/2005 Scrogin et al. ..... 42/119
2008/0144181 A1 6/2008 Pniel
2009/0189513 A1 7/2009 Lane
2009/0213362 A1 * 8/2009 Nakamura et al. ..... 356/72
2012/0011733 A1 * 1/2012 Lais ..... 33/301

* cited by examiner

*Primary Examiner* — Christopher Fulton
(74) *Attorney, Agent, or Firm* — Daly, Crowley, Mofford & Durkee, LLP

(57) ABSTRACT

An apparatus comprises a light source which produces a first radiation within a first wavelength range and which produces a second radiation within a second wavelength range when a property of the light source is changed. The apparatus further comprises an optical device which receives the first radiation and attenuates the first radiation to emit a first attenuated radiation having a first perceived brightness. The optical device also receives the second radiation and attenuates the second radiation to emit a second attenuated radiation having a second perceived brightness. The first and second perceived brightnesses are approximately equal.

24 Claims, 4 Drawing Sheets

METHOD AND SYSTEM FOR ATTENUATING A WAVELENGTH SHIFTING SOURCE

TECHNICAL FIELD

This disclosure relates in general to apparatus and techniques for managing the effects of spectral shift in a light source and, more particularly, to apparatus and techniques for managing the effects of a spectral shift in a light source within an optical sight.

BACKGROUND

Optical sights are used for various purposes, one example of which is mounting a sight on a weapon in order to help a user accurately aim the weapon. The optical sight takes image information from a distant scene, and presents this image information within a field of view which is visible to the eye of a user.

In reflex gun sights, a positioning marker or image, such as cross-hairs, a luminous dot, or other type of reticle is superimposed onto the visible field of view to aid a marksman in aiming the weapon and hitting the target within the field of view. The positioning marker can be generated using a light source such as a light emitting diode (LED). Changes in one or more physical properties of the light source, such as drive current or temperature, can cause a spectral shift in the light emitted from the light source. Additionally, individual units of the same nominal light source can have spectral shifts relative to the nominal source. This shift can produce undesirable effects such as changes in perceived brightness or a shift in the hue of the light. A change in perceived brightness is due to the eye's variable sensitivity to the color, or wavelength, of the light. As the emitted wavelength spectrum of the light source shifts toward wavelengths to which the human eye is more visually sensitive, the eye perceives this shift as a brightening of the light source. As the emitted wavelength spectrum of the light source shifts toward wavelengths to which the human eye is less visually sensitive, the eye perceives the shift as a dimming of the light source. These spectral shifts can also influence the perceived hue of the light source. The effects of spectrum shift also occur when mixing multiple color light sources to create computer or other visual displays. In a reflex gun sight, the effects of spectral shift can cause the reticle to appear too bright, distracting the user from the field of view, or too dim, causing the user difficulty in discerning the reticle against the field of view.

New apparatus and methods are needed to overcome the effects of spectral shifting.

SUMMARY

In one exemplary aspect, an apparatus comprises a light source which produces a first radiation within a first wavelength range and which produces a second radiation within a second wavelength range when a property of the light source is changed. The apparatus further comprises an optical device which receives the first radiation and attenuates the first radiation to emit a first attenuated radiation having a first perceived brightness. The optical device also receives the second radiation and attenuates the second radiation to emit a second attenuated radiation having a second perceived brightness. The first and second perceived brightnesses are approximately equal.

In another exemplary aspect, a sighting apparatus comprises an elongated housing including a first end and a second end defining an optical axis. The second end is configured to admit external light from an external scene. The sighting apparatus also includes a light source within the housing which produces a first light within a first wavelength spectrum and which produces a second light within a second wavelength spectrum when a property of the light source is changed The apparatus also includes an optical device which combines the external light with the first light to create a first combined light and attenuates the first combined light to emit a first attenuated light having a first perceived brightness. The optical device also combines the external light with the second light to create a second combined light and attenuates the second combined light to emit a second attenuated light having a second perceived brightness, wherein the first and second perceived brightnesses are approximately equal.

In another exemplary aspect, a method comprises projecting from a light source a first radiation within a first wavelength range and responsive to a change in a property of the light source, projecting from the light source a second radiation within a second wavelength range. The method also includes receiving at an optical device the first and second radiations. The method also includes conveying from the optical device an attenuated form of the first radiation having a first perceived brightness and conveying from the optical device an attenuated form of the second radiation having a second perceived brightness. The first and second perceived brightnesses vary by less than 10%.

Further aspects, forms, embodiments, objects, features, benefits, and advantages of the present invention shall become apparent from the detailed drawings and descriptions provided herein.

DETAILED DESCRIPTION

Figure 1:
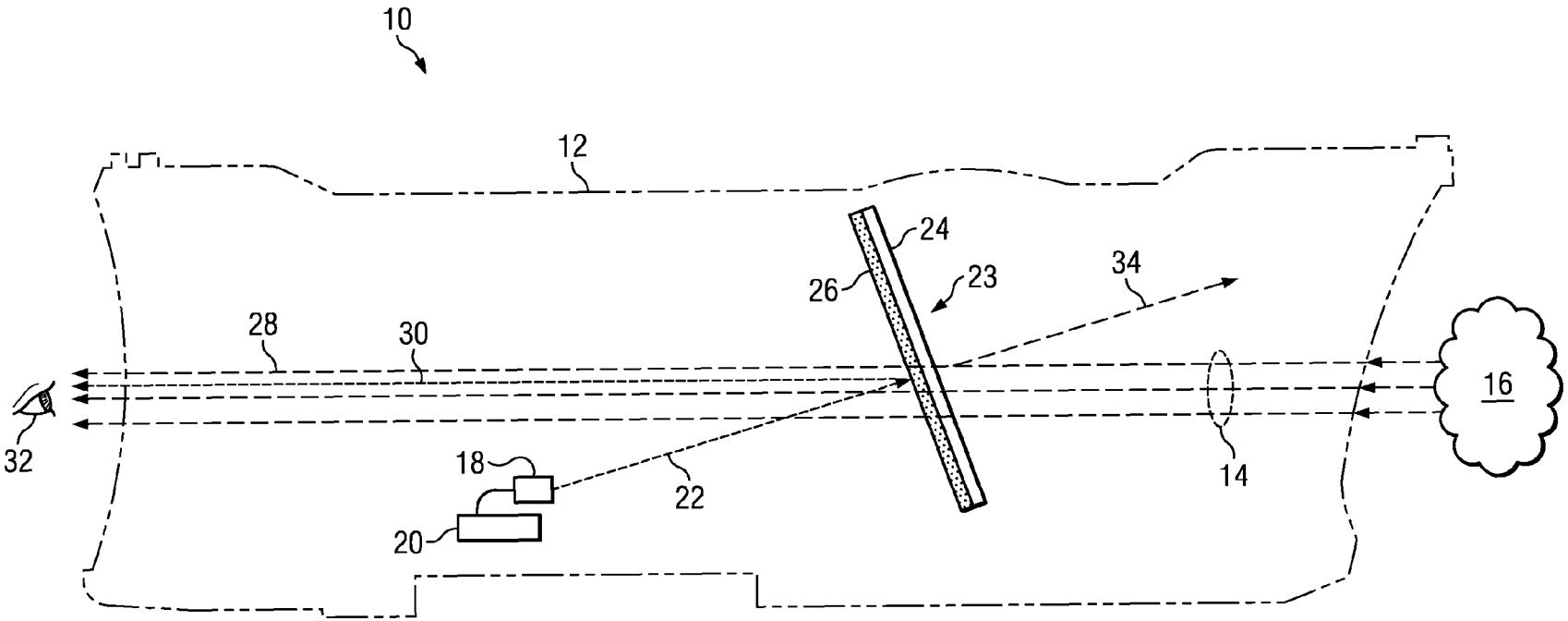
FIG. 1 is diagrammatic depiction of an apparatus which is an optical sight for a weapon.

For the purposes of promoting an understanding of the principles of the invention, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 is a diagrammatic view of an optical apparatus 10 which in this embodiment may be a sight for a weapon. For example, the sight 10 could be mounted on a rifle, in order to assist a marksman in aiming the rifle at a target within distant scene. FIG. 1 does not depict all of the structure of the sight 10, but only selected components which facilitate an understanding of the present invention.

The sight 10 has a housing, which is represented diagrammatically in FIG. 1 by a broken line 12. Lines 14 represent visible light radiation which embodies an image of a remote external scene 16. In this embodiment, the radiation 14 may be a broadband or "white light" radiation. The external scene 16 could be any of a wide variety of different things, and is therefore depicted diagrammatically in FIG. 1 by a broken line.

The sight 10 also includes a light source 18 which may include, for example, an LED, a laser, or a liquid crystal display (LCD), powered by a power supply 20, such as a battery. Line 22 represents visible light radiation which embodies an image of a marker. The image may be a colored dot, a set of cross-hairs, alpha/numeric text, or any other figure that may be used as a position marker or to provide information that may be helpful to a user. In this embodiment, the radiation 22 may be a relatively narrowband or monochromatic color light. In other embodiments, as will be described, the light source or multiple light sources may emit multiple narrowband or monochromatic light radiations.

The sight 10 also includes an optical device 23 which includes a lens 24 and a filter 26. The lens 24 is located within the optical path of both the broadband radiation 14 and the narrowband radiation 22. The lens 24 may carry the filter 26. In this embodiment, the filter may be applied to a single surface of the lens, but in alternative embodiments of optical devices, the filter may be spaced apart from the lens, applied to multiple surfaces of the lens or embedded on or in a layered optical device. In this embodiment, filter 26 is a dichroic combining filter. The filter 26 may be implemented as a bandpass or edge filter.

In this embodiment, the filter 26 reflects a portion of the narrowband radiation 22, creating reflected radiation 30 and transmits a portion of the broadband radiation 14, creating transmitted radiation 28. Conveyed radiations 28 and 30 are combined and travel through the sight 10 to an eye (or a sensor) 32. A portion of the radiation 14 shown as radiation 34 is reflected and is not combined with the radiation 30.

For example, if the light source 18 emits a generally monochromatic red light radiation 22 and the filter 26 is selected or tuned to reflect red light, it will convey red light radiation 30 toward the eye 32. However, it will also reflect red light radiation 34 from the broadband radiation 14 so that the transmitted radiation 28 does not include red light radiation. Consequently, the transmitted radiation 28 may appear dim and overly saturated with green light.

It is understood that the sight 10 may also include other optical devices such as other lenses, filters, prisms, light sources, or mirrors.

Figure 2:
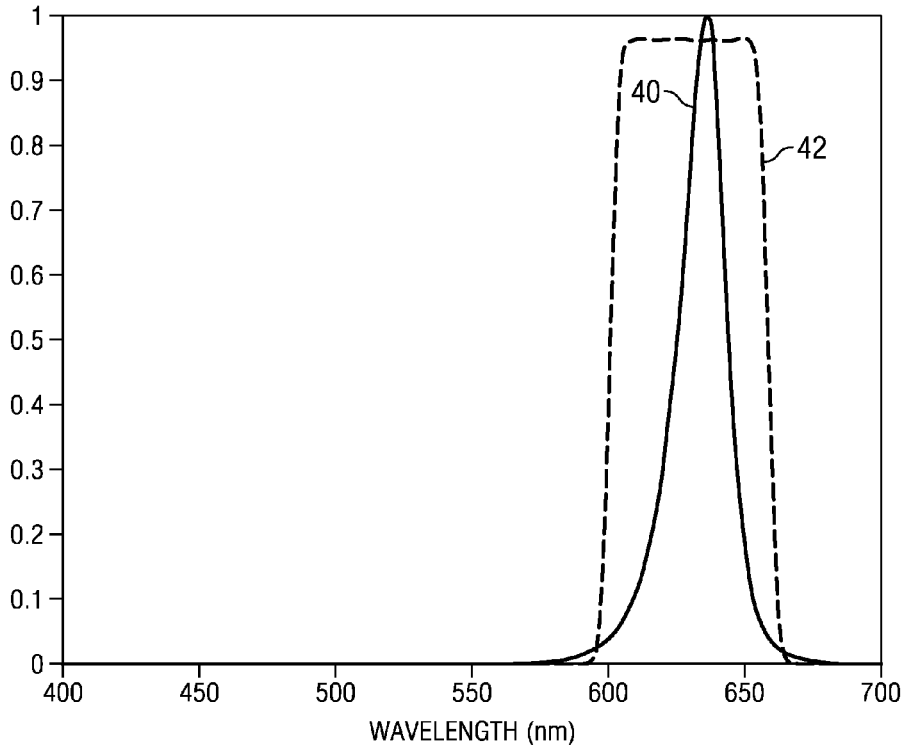
FIG. 2 is graph depicting a narrowband spectrum of radiation and the transmission/reflection characteristics of a nominal filter.

FIG. 2 is a graph that explains the operation of a filter, such as a filter that may be used for filter 26. The horizontal axis represents wavelength, increasing from left to right. The solid line 40 represents the spectrum of a narrow band light source, such as light source 18, and the broken line 42 represents the reflection characteristic of a nominal filter. In this embodiment, the nominal filter is selected to reflect the majority of the spectrum from the light source. Even if the spectrum shifts to longer or shorter wavelengths by 10 nm due to changes in a physical property of the light source such as temperature, changes in drive current, part variability, deviation of the peak wavelength from a nominal peak wavelength, or other causes, the nominal filter conveys the majority of the narrow band spectrum toward the eye 32. Additionally, the nominal filter reflects (as radiation 34) the portion of the broadband spectrum 14 that falls within the reflection characteristic 42 of the nominal filter.

Figure 3:
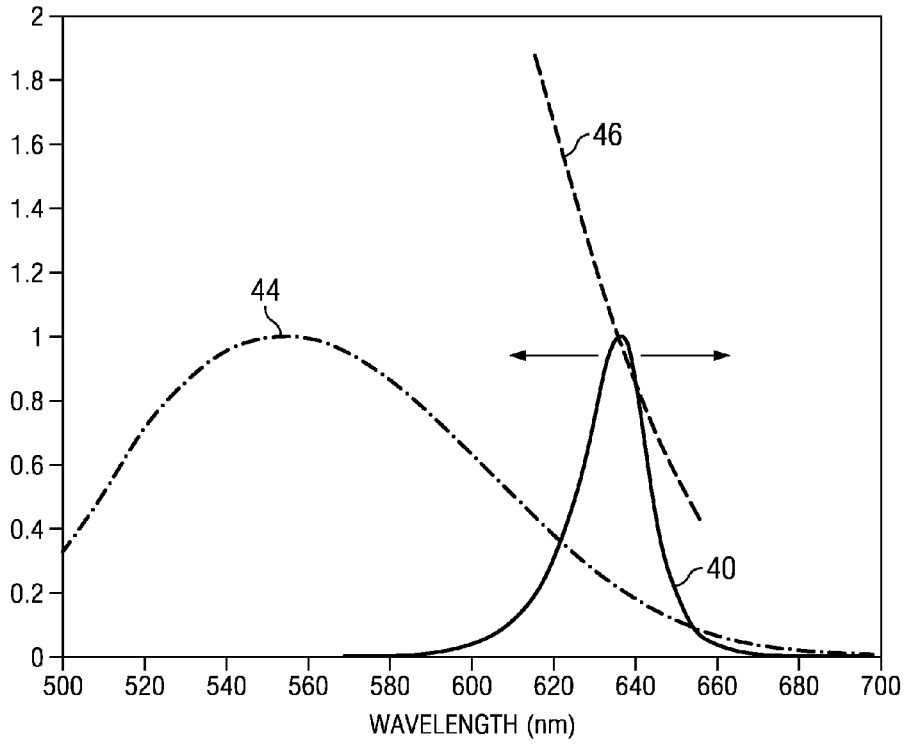
FIG. 3 is a graph depicting a narrowband spectrum of radiation, a photopic luminous response curve, and the change in perceived brightness of the narrowband radiation.

FIG. 3 is a graph that explains how the perceived brightness of a light source changes as the spectrum shifts. Again, the solid line 40 represents the spectrum of a narrow band light source. The line 44 represents the photopic luminous response of a typical human eye. The line 46 represents the perceived brightness of the unfiltered light source as the spectrum shifts up and down from the nominal position. As shown, when the peak wavelength is shifted between approximately 660 nm and 620 nm, the brightness is increased by a factor of four. A shift in the spectrum of a red or orange light toward the shorter wavelengths would therefore appear to the viewer as an increase in the perceived brightness of the light source, with all other things being approximately equal.

Figure 4:
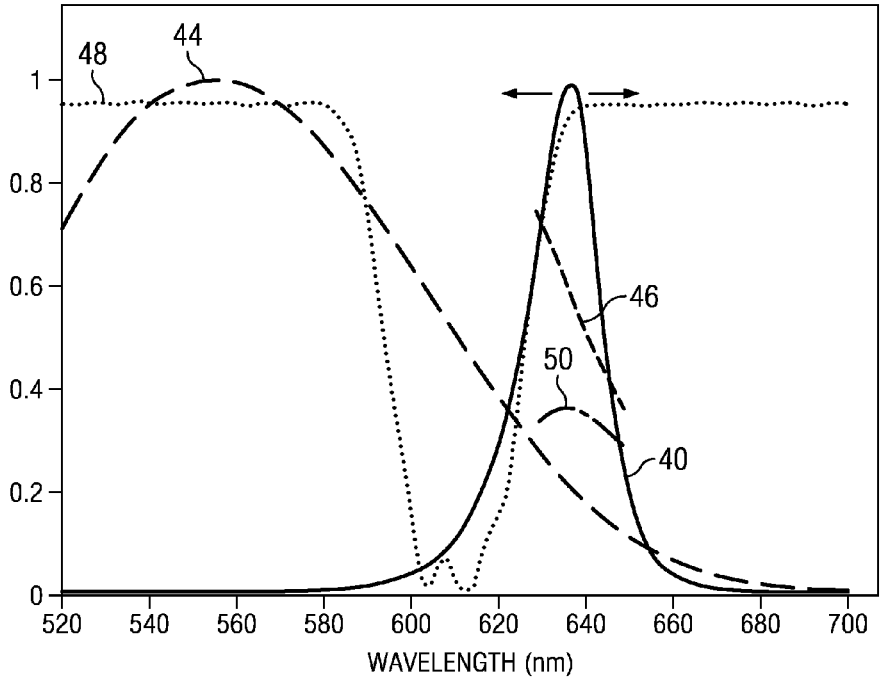
FIG. 4 is a graph depicting a narrowband spectrum of radiation, a photopic luminous response curve, the transmission/reflection characteristics of a filter for attenuating shorter wavelengths, and the change in perceived brightness of the narrowband radiation for both the filtered and unfiltered narrowband radiation.

FIG. 4 is a graph that explains how the application of an alternative filter (that may be used for filter 26) attenuates reflected wavelengths shorter than approximately 630 nm. The lines 40, 44, and 46 represent information as explained above for FIG. 3. The line 48 represents the transmission/reflection characteristic of the filter of this alternative embodiment. The line 50 represents the perceived brightness of the filtered light source as the spectrum shifts up and down from its nominal position. As line 50 shows, when the peak wavelength is shifted between approximately 660 nm and 620 nm, the filtered perceived brightness is relatively flat or equal in that it varies by less than approximately 10%. It is understood that an optimal filter with an optimal transmission/reflection curve may be selected or tuned based upon known characteristics of the light source, including the nominal emitted spectrum and the expected shift due to changes in physical properties of the light source.

Figure 5:
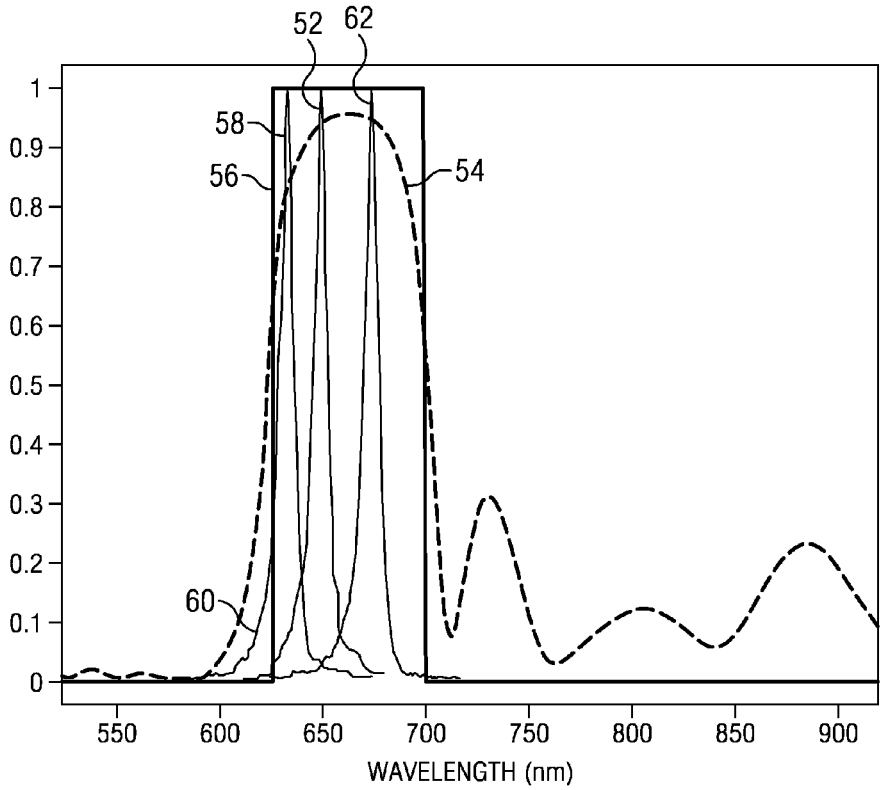
FIG. 5 is a graph depicting a narrowband spectrum of radiation in both nominal and shifted positions, the transmission/reflection characteristics of a filter for attenuating the radiation, and a model square filter.

FIG. 5 is a graph that explains the application of still another more optimized alternative filter (that may be used for filter 26). The line 52 represents the nominal spectrum of a narrow band light source (such as may be used for light source 18). The line 54 represents the transmission/reflection characteristic of a shifted filter of this alternative embodiment. The line 56 represents a model square filter that would give approximately the same effect as the shifted filter represented by line 54. The model square filter and the filter represented by line 54 are centered on a wavelength offset or shifted from the center of the spectrum represented by line 52. In this embodiment, the filters are offset away from the shorter wavelengths. The filters may also be configured to reflect a narrower spectrum of light than the filter shown in FIG. 2. For example, the shorter edge of the filters (i.e., the edge closest to the shorter wavelengths) may be moved closer to nominal spectrum 52 of the light source, leaving the longer edge of the filters (i.e., the edge closest to the longer wavelengths) unchanged.

The line 58 represents a shift in the spectrum of the narrow band light source due to, for example, a change in a physical property of the light source such as temperature, drive current, or any of the factors listed above. When the spectrum shifts, the filters of this embodiment attenuate reflected light radiation 60 in the shorter wavelength region of the spectrum, the region most sensitive to the human eye. The result of this attenuation is that the perceived brightness of the light source remains approximately equal to the perceived brightness when the spectrum was in the nominal position 52. For example, the perceived brightness may be considered "approximately equal" if the variance is less than 20%, and preferably less than 10%. Line 62 represents another shift in the spectrum of the narrow band light source, this time toward the longer wavelengths. With this shift, the filters attenuate less of the spectrum, but the perceived brightness is still approximately equal to the perceived brightness when the spectrum was in the nominal position 52 and in the shifted position 58.

The filters associated with lines 54 and 56 may be tuned or selected based upon the characteristics of the light source. For example, the integral of the source spectrum weighted by the photopic response and the filter response over the wavelength range may be solved to be approximately constant over source spectrum shifts.

Figure 6:
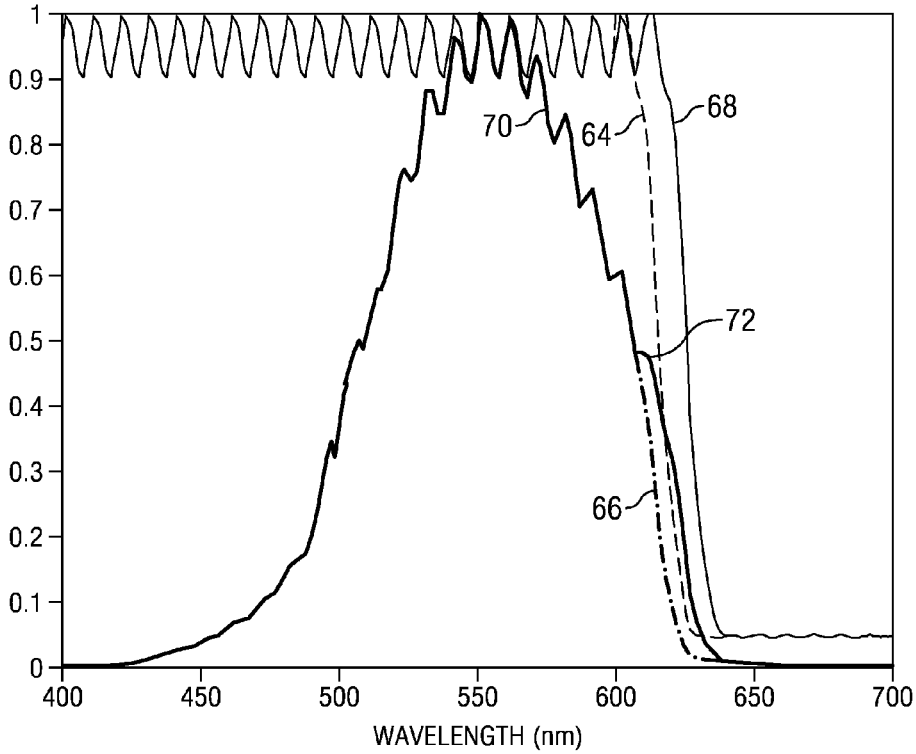
FIG. 6 is a graph depicting broadband spectrums of radiation conveyed by two different filters.

The graphs of FIGS. 2-5 have depicted spectrums of a narrow band light source, such as light source 18, without showing the effect of the various filters on external broadband light radiation, such as radiation 14, which may be combined with the narrowband light radiation as explained above. FIG. 6 is a graph that explains the effect of the shifted filter of FIG. 5 on the broadband radiation. Line 64 represents the transmission/reflection characteristic of a nominal, relatively centered filter as described above for FIG. 2. Line 66 represents the spectrum of a broadband light filtered by the nominal filter of FIG. 2. Line 68 represents the transmission/reflection characteristic of a shifted filter as described above for FIG. 5. Line 70 represents the spectrum of a broadband light filtered by the shifted filter of FIG. 5. Area 72 of the spectrum of line 70 represents additional radiation passed by the shifted filter that may make the broadband light appear brighter and display less of a hue shift. Thus, using the shifted filter of FIG. 5 as the filter 26 accommodates a spectral shift in the narrowband light radiation without causing a significant change in perceived brightness of the narrowband light radiation. Because the shifted filter may also reflect a narrower spectrum of light than the nominal filter, the reflected broadband radiation 34 also has a narrower spectrum, permitting more of the external broadband light to reach the eye of the user and reducing the hue shift of the transmitted broadband light.

Figure 7:
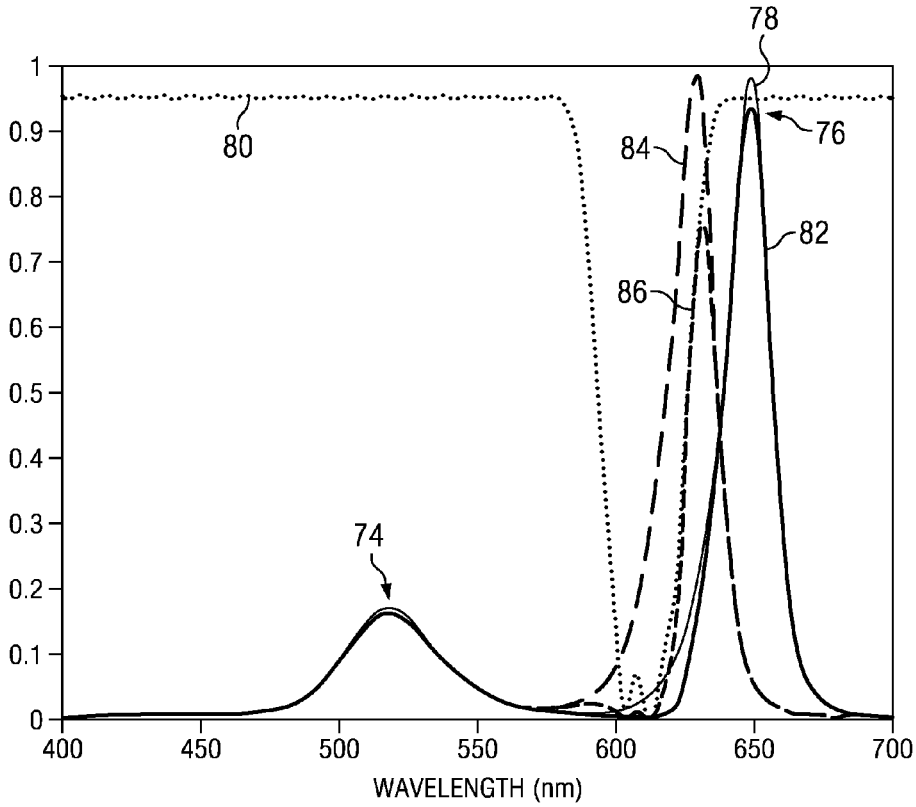
FIG. 7 is a graph depicting the filtering of two narrowband light sources.

In another alternative embodiment, an optical apparatus may include multiple narrowband light sources that combine to form a mixed hue. With a nominal filter that broadly reflects the multiple narrowband radiations, the color of the combined light radiation may shift as one or more of the spectrums shift. This phenomena is depicted in FIG. 7. In this embodiment, generally monochromatic green light 74 from a first light source is mixed with generally monochromatic red light 76 from a second light source. The resulting mix of light would have an orange hue. Line 78 represents the mixed and unfiltered, nominal (unshifted) light. Line 80 represents the transmission/reflection characteristic of a filter for filtering both the red and the green light. Line 82 represents the mixed nominal (unshifted) light reflected by the filter represented by line 80. Line 84 represents a shifted red source with a spectral shift due to changes in temperature, drive current, or another physical property of the light source. The shift primarily affects the red light. The shifted red light causes the unfiltered mixed light to change from a deep orange hue to an orange-green color. Line 86 represents the shifted red light that has been filtered by the filter represented by line 80. Because the filter attenuates shorter wavelengths in the shifted red light, the mixed light remains primarily orange with minimal amounts of green. Thus, the filter selected or tuned to the specific monochromatic light sources is able to limit the shift in hue that would accompany spectral shift in unfiltered mixed light.

In the above recited embodiments, the level of perceived brightness has been based upon the human photopic luminosity curve which is generally based upon daytime levels of light. It is understood that perceived brightness may, alternatively, be based upon a human scotopic luminosity curve that is generally based upon dim-lighting conditions.

Although the optical devices described above may be well suited for application in optical sights, they may also be broadly applied to other applications in which spectral shifting of a light source would otherwise result in undesirable changes in perceived brightness or in perceived hue. For example, the techniques and apparatus described herein may be applied to attenuate spectrum shifting in monochromatic or multichromatic light sources used in a wide variety of applications including computer displays, televisions, digital photo frames, projectors, and e-books.

Although several selected embodiments have been illustrated and described in detail, it will be understood that they are exemplary, and that a variety of substitutions and alterations are possible without departing from the spirit and scope of the present invention, as defined by the following claims.

What is claimed is:

1. An apparatus comprising:

a light source which produces a first radiation within a first wavelength range and which produces a second radiation within a second wavelength range when a property of the light source is changed and an optical device which receives the first radiation and attenuates the first radiation to emit a first attenuated radiation having a first perceived brightness and which receives the second radiation and attenuates the second radiation to emit a second attenuated radiation having a second perceived brightness, wherein the first and second perceived brightnesses are approximately equal.

2. The apparatus of claim 1 wherein the first and second perceived brightnesses vary by less than 10%.

3. The apparatus of claim 1 wherein the first and second perceived brightnesses vary by less than 20%.

4. The apparatus of claim 1 wherein the light source includes a light emitting diode.

5. The apparatus of claim 1 wherein the property of the light source is a drive current.

6. The apparatus of claim 1 wherein the property of the light source is a peak wavelength.

7. The apparatus of claim 1 wherein the property of the light source is a temperature.

8. The apparatus of claim 1 wherein the optical device comprises a filter.

9. The apparatus of claim 8 wherein the filter is a bandpass filter.

10. The apparatus of claim 9 wherein the bandpass filter has a bandwidth of approximately 75 nm.

11. The apparatus of claim 9 wherein the first wavelength range includes a peak wavelength and wherein the filter has a passband offset from the peak of the first wavelength range.

12. The apparatus of claim 8 wherein the filter is an edge filter.

13. The apparatus of claim 9 wherein the optical device comprises a dichroic combining filter.

14. The apparatus of claim 1 wherein the first and second radiations are each generally monochromatic.

15. The apparatus of claim 1 wherein the first and second radiations are each multichromatic.

16. A sighting apparatus comprising:

an elongated housing including a first end and a second end defining an optical axis, wherein the second end is configured to admit external light from an external scene;

a light source within the housing which produces a first light within a first wavelength spectrum and which produces a second light within a second wavelength spectrum when a property of the light source is changed;

an optical device which combines the external light with the first light to create a first combined light and attenuates the first combined light to emit a first attenuated light having a first perceived brightness and combines the external light with the second light to create a second combined light and attenuates the second combined light to emit a second attenuated light having a second perceived brightness, wherein the first and second perceived brightnesses are approximately equal.

17. The apparatus of claim 16 wherein the first and second perceived brightnesses vary by less than 10%.

18. The apparatus of claim 16 wherein the first and second perceived brightnesses vary by less than 20%.

19. The apparatus of claim 16 wherein the optical device includes a dichroic filter.

20. The apparatus of claim 16 wherein the sighting apparatus is an optical sight adapted for mounting to a weapon.

21. A method comprising:

projecting from a light source a first radiation within a first wavelength range;

responsive to a change in a property of the light source, projecting from the light source a second radiation within a second wavelength range;

receiving at an optical device the first and second radiations;

conveying from the optical device an attenuated form of the first radiation having a first perceived brightness; and conveying from the optical device an attenuated form of the second radiation having a second perceived brightness, wherein the first and second perceived brightnesses vary by less than 10%.

22. The method of claim 21 further comprising receiving at the optical device a third radiation from an external scene.

23. The method of claim 22 further comprising combining the first and third radiations and combining the second and third radiations.

24. The method of claim 22 further comprising minimizing a hue shift of the third radiation when combined with the first radiation and when combined with the second radiation.

* * * * *